US006991106B2

(12) United States Patent
Milliorn

(10) Patent No.: US 6,991,106 B2
(45) Date of Patent: Jan. 31, 2006

(54) MODULAR CONTAINER FOR HOLDING LABELS

(75) Inventor: J. Michael Milliorn, Fort Worth, TX (US)

(73) Assignee: Ecolab Inc., St. Paul, MN (US)

( * ) Notice: Subject to any disclaimer, the term of this patent is extended or adjusted under 35 U.S.C. 154(b) by 361 days.

(21) Appl. No.: 10/121,124

(22) Filed: Apr. 11, 2002

(65) Prior Publication Data

US 2003/0192805 A1 Oct. 16, 2003

(51) Int. Cl.
*B65D 83/00* (2006.01)
*B65D 85/671* (2006.01)

(52) U.S. Cl. ..... 206/409; D19/67; 206/411; 220/23.4; 221/25; 221/70; 242/594.2

(58) Field of Classification Search ..... 206/408, 206/409, 411, 39, 39.3, 39.5–39.8, 449, 459.5; 221/25, 70; D19/67; 242/588.4, 588.6, 594.2, 242/594.3; 220/23.4; 225/34, 37, 38
See application file for complete search history.

(56) References Cited

U.S. PATENT DOCUMENTS

| | | | | | |
|---|---|---|---|---|---|
| 777,044 | A | | 12/1904 | McWilliam | |
| 920,670 | A | | 5/1909 | Scott | |
| 1,951,972 | A | * | 3/1934 | Fraser | 211/126.3 |
| D125,085 | S | | 2/1941 | Jackson | |
| 2,295,477 | A | | 9/1942 | Jackson | |
| D164,733 | S | | 10/1951 | Pretzfelder | |
| 2,676,861 | A | | 4/1954 | Belew | |
| 3,131,829 | A | | 5/1964 | Masser | |
| 3,300,057 | A | | 1/1967 | Wheaton | |
| 3,338,452 | A | * | 8/1967 | Oakley et al. | 220/23.4 |
| 3,369,658 | A | | 2/1968 | Hasselmann | |
| 3,502,252 | A | * | 3/1970 | Mariani | 225/33 |
| 3,749,273 | A | | 7/1973 | Wreghitt et al. | |
| 3,972,459 | A | | 8/1976 | Cooper | |
| 4,060,444 | A | | 11/1977 | Schweig | |
| 4,192,562 | A | * | 3/1980 | Bishoff et al. | 312/108 |
| 4,328,902 | A | | 5/1982 | North | |
| 4,480,745 | A | * | 11/1984 | Loge et al. | 211/85.26 |
| 4,527,722 | A | * | 7/1985 | Strachan | 225/106 |
| 4,700,835 | A | | 10/1987 | Rognsvoog | |
| 4,735,342 | A | * | 4/1988 | Goldstein | 221/25 |
| 4,787,168 | A | | 11/1988 | Benit | |
| 4,889,254 | A | | 12/1989 | Vola | |
| 5,111,942 | A | | 5/1992 | Bernardin | |
| 5,123,582 | A | * | 6/1992 | Lo | 225/25 |
| D327,965 | S | | 7/1992 | Chelec | |
| D338,493 | S | | 8/1993 | Mead | |
| 5,240,126 | A | | 8/1993 | Foster et al. | |
| 5,431,294 | A | | 7/1995 | Stottmann et al. | |
| 5,469,961 | A | | 11/1995 | Chang | |
| 5,494,204 | A | * | 2/1996 | Wang | 225/25 |
| 5,503,288 | A | | 4/1996 | Conconi | |
| 5,735,400 | A | | 4/1998 | Packard | |
| 5,950,959 | A | | 9/1999 | Milliorn | |
| D421,335 | S | * | 3/2000 | Linard | D3/314 |
| 6,386,416 | B1 | | 5/2002 | Dunshee | |
| 6,481,607 | B1 | | 11/2002 | Van Cott | |

* cited by examiner

*Primary Examiner*—Jim Foster
(74) *Attorney, Agent, or Firm*—Andrew D. Sorensen; Anneliese M. Siefert

(57) ABSTRACT

A modular container system for storing and dispensing labels, the container system including a plurality of individual container modules configured for mutual coupling. Each container module having a first engagement element on a first wall and a complementary second engagement element on a second wall and each container module further including a receptacle configured for receiving a roll of labels and an opening for dispensing the labels.

14 Claims, 4 Drawing Sheets

MODULAR CONTAINER FOR HOLDING LABELS

FIELD OF THE INVENTION

The present invention relates to containers, and more particularly, to a modular container system for storing and dispensing multiple rolls of labels.

BACKGROUND OF THE INVENTION

In the food industry, labels are a necessary item and are used for a variety of purposes. For example, labels are used to indicate the expiration date, use date or desired storage temperature of food products. The type and number of labels needed at a particular work area vary. The requirements will be different in different establishments, and indeed even at different work areas within the same establishment.

Labels of various kinds are sold in rolls. The labels have adhesive backings and during manufacture are placed on a lined paper. The lined paper with the adhesive-backed labels are wound on a cylindrical core, which may be made of paperboard or plastic. The rolls of labels are typically packaged in a paperboard box with one roll per box. The rolls of labels come in different widths depending upon the text of the labels.

A roll of labels dispenses easily from its box, and the adhesive-backed labels peel easily from the lined paper. However, because the boxes are not transparent, one cannot readily tell which labels are in which box or when a roll is nearing completion. Thus, a consumer frequently does not know the inventory of a particular label is low until essentially the last label has been dispensed. Further, when a number of different labels are used and each roll of labels is in its own separate box, it is cumbersome to work with numerous boxes of labels.

A container for storing and dispensing multiple rolls of labels is described in U.S. Pat. No. 5,950,959, issued to Milliorn. This patent describes a container for storing and dispensing multiple rolls of labels. The container is a clamshell container having a generally cylindrical shape with flanges extending from a longitudinal plane. The top section is connected to the bottom section along the back edge of each. The bottom section has a plurality of semi-cylindrical compartments separated by partitions and each compartment is configured for holding a roll of labels. Each container is designed to hold a particular number of rolls of labels of particular sizes. However, the clamshell container precludes the user from being able to have a label dispenser that will accommodate a variety of sizes of rolls within a single clam shell.

A number of modular systems have also been disclosed. For example, U.S. Pat. No. 3,131,829, issued to Masser, describes containers which may be interlocked to form a carrying case composed of a plurality of individual containers. U.S. Pat. No. 5,469,961, issued to Chang, describes minidisc boxes which may be connected with other minidisc boxes on its left, right, and bottom sides. Similarly, U.S. Pat. No. 5,503,288, issued to Conconi, discloses a first-half shell which may be mutually coupled to a second-half shell to form a container, which may be further coupled with engagement elements on the half-shell of an adjacent container. However, none of these modular systems would be useful for dispensing labels. They do not provide an appropriate receptacle for holding the rolls of labels; nor do they allow for easy dispensing of the labels.

It would be advantages to have a number of connected containers for storing and dispensing multiple rolls of different labels that would allow for visualization of the rolls of labels.

It would also be advantages to have a series of modular containers of varying width that can be connected in any selected arrangement of widths for accommodating a variety of labels.

Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention. The foregoing has outlined rather broadly the features and technical advantages of the present invention in order that the detailed description of the invention that follows may be better understood.

SUMMARY OF THE INVENTION

The object of the present invention is to provide a modular container system for storing and dispensing labels which is designed such that it can be customized to suit the needs of any particular work area. To this end, the modular container system has a plurality of individual container modules that can be mutually coupled to form such a system. Adjoining modules are connected by means of corresponding male and female engagement elements.

The first or male engagement element is a panel that is parallel to and contiguous with a first wall of the module and the second or female engagement element is a protruding lip that extends across the entire length of the top and down each side of a second wall of the module.

Each container module has an aperture in the back wall to attach each module to a vertical surface, and feet to rest the modular container system on a flat surface. Additionally, each container module has notches in the lower right and left corners of each side to provide flexibility to the attached modules.

The container module includes a receptacle that is shaped to facilitate the storage and dispersion of labels, and openings are provided at the front of each module for dispersion of the labels to the user.

The modular container system can be customized for a particular work area by adding, removing or interchanging the individual container modules as the needs of a particular work area demand.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE INVENTION

Figure 1:
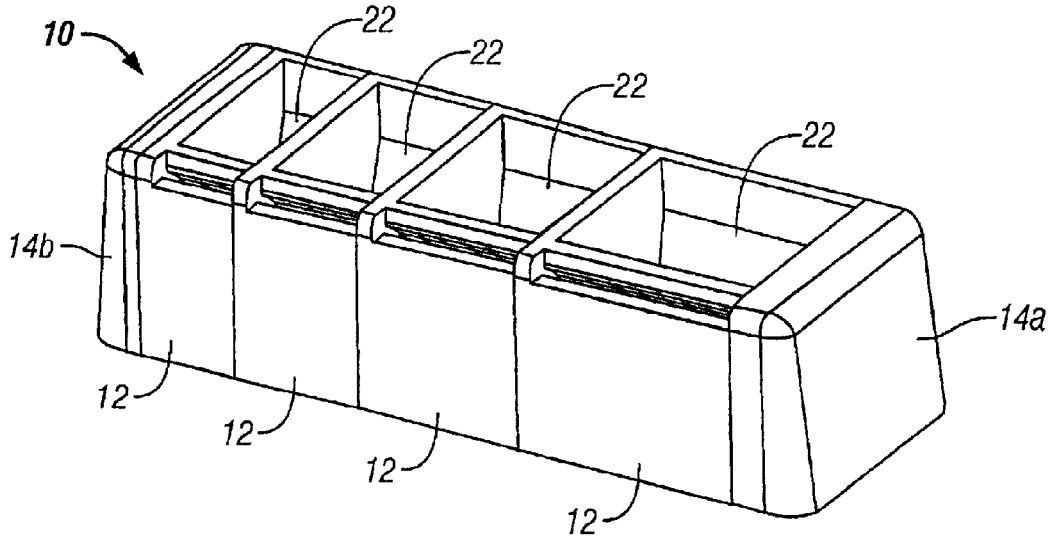
FIG. 1 is a perspective view of a modular container system in accordance with the invention.
Figure 2:
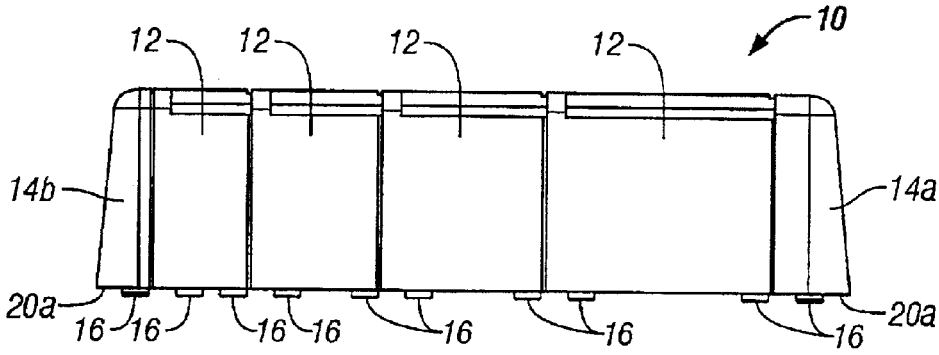
FIG. 2 is a front view of the container system of FIG. 1.
Figure 3:
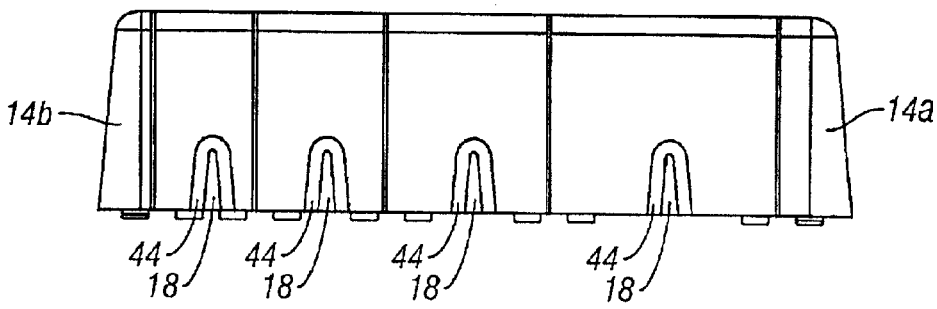
FIG. 3 is a back view of the container system of FIG. 1.
Figure 4:
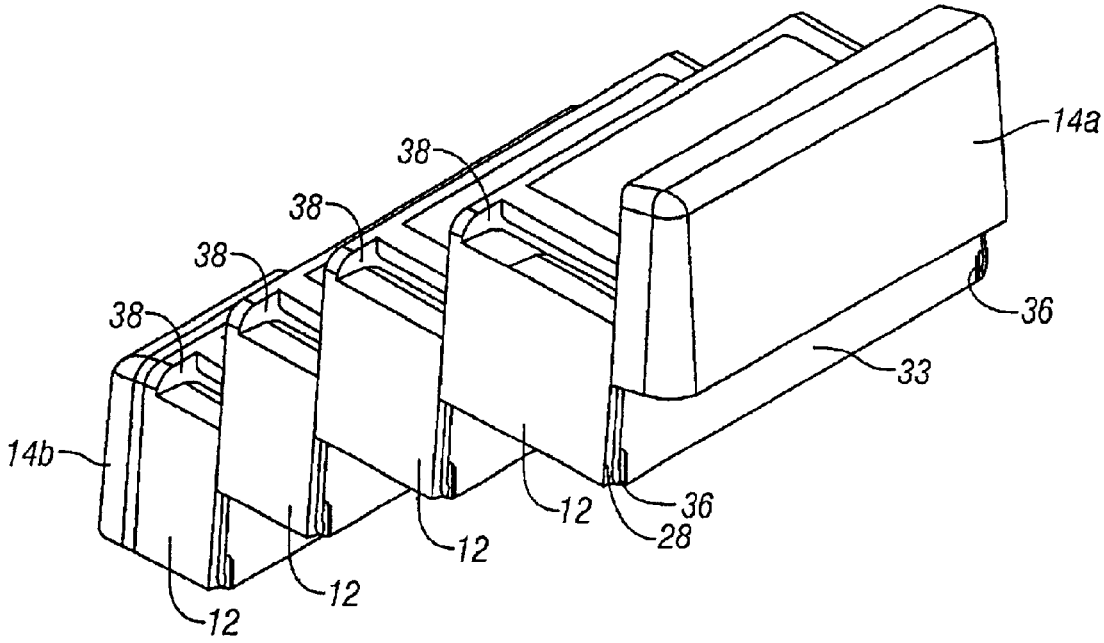
FIG. 4 is an exploded view in perspective illustrating the mode of joining the modules in accordance with the invention.
Figure 5:
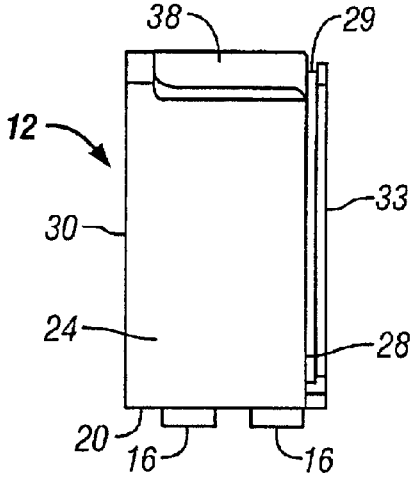
FIG. 5 is front view of an individual module of the container of FIG. 1.

With reference to FIGS. 1–3, a modular container system 10 has a plurality of individual container modules 12 that can be mutually coupled together to form a modular container system 10. The number of individual modules 12 that can be coupled is variable, however at least two modules 12 could be connected to form the modular container system 10. Each module 12 is designed to store and dispense a roll of labels. Labels typically have an adhesive backing which is pressure sensitive so that each label can be applied to a surface of an object by pressing the label onto the surface. The adhesive-backed labels are temporarily adhered onto a lined paper, which is a slick paper from which the adhesive-backed labels can be easily removed. The liner paper and the adhesive-backed labels are wound about a paperboard core to provide a roll of labels.

Preferably, an end piece 14 attaches to each end of a series of coupled individual container modules 12. Each module 12 includes two opposing pairs of feet 16 for standing the container system on a flat surface and preferably an aperture 18 is located on the back wall of each module 12 for attaching the container modules 12 to a vertical surface, such as a wall.

With reference to FIGS. 5–9, each module 12 has a bottom surface 20 substantially rectangular in outline and a plurality of walls extending upwardly from the periphery of the bottom surface 20 in such a way as to form a four sided container. In an exemplary embodiment of the present invention, there are four walls—a front wall 24, a back wall 26, and when facing the front wall, a right wall 28, and a left wall 30. The individual modules 12 can be formed by injection molding, and can be made from any appropriate plastic, as is known to those skilled in the art.

The modular containers 12 can be of any rectangular dimension. However, in one embodiment, the container 12 can have a length of about 8 inches, a height of about 3 inches and a width ranging from 1.5 to 4 inches. The container 12 is provided in a variety of widths in order to conform to rolls of labels having different widths.

An advantageous feature of the invention is found in the fact that the container modules 12 have elements allowing for mutual coupling of adjacent modules 12. The modular container system 10 can be created and used as a portable container for taking a plurality of labels to a work area. FIGS. 1–4 illustrate a modular system 10 for use in a food storage or preparation area where the container has four modules 12 connected together to receive four rolls of labels of various sizes. The number of modules 12 may be as few as one or can be many, depending on what is needed to serve the needs of the particular work area.

Each container module 12 is configured to provide for mutual coupling of the modules 12. For example, FIGS. 5–9 show an individual container module 12 with a first or male engagement element 32 on one outside wall of each module 12 and a second or female engagement element 34 on the opposing outside wall of each module 12. FIGS. 5–8 illustrate an exemplary embodiment of the male engagement element 32. The right wall 28 of each container module 12 is configured to provide a panel 33 that is parallel to and contiguous with right wall 28. In a preferred embodiment, panel 33 extends out from the right wall 28 a distance of about 0.15 inches. Panel 33 is smaller in dimension than the right wall 28 along the top and side edges of the panel 33. A groove 29 separates the panel 33 from the right wall 28 as illustrated best in FIGS. 5, 6 and 10.

Figure 9:
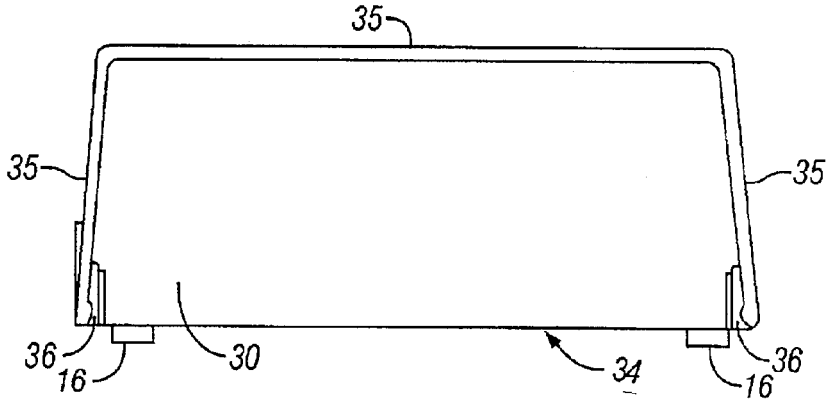
FIG. 9 is a left side view of the individual module of FIG. 7.
Figure 10:
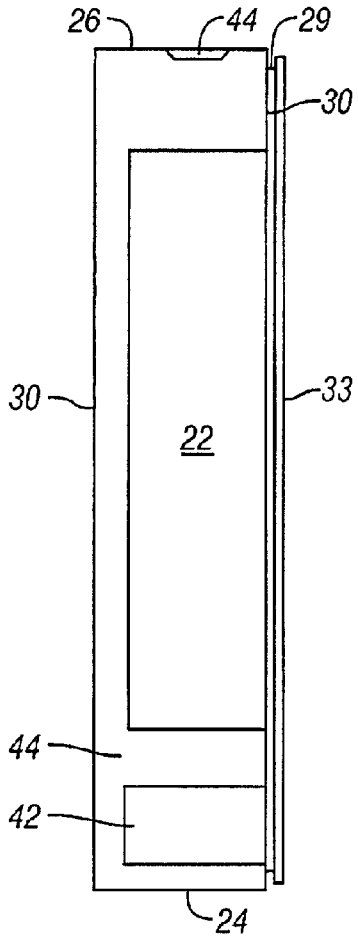
FIG. 10 is a top view of the individual module of FIG. 7.
Figure 11:
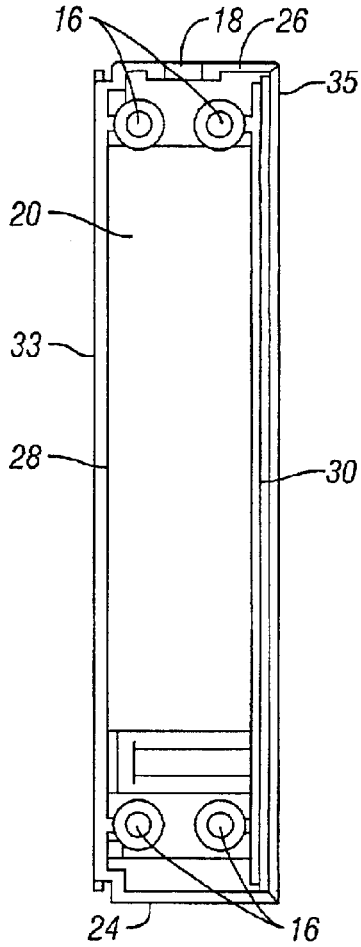
FIG. 11 is a bottom view of the individual module of FIG. 7.

FIG. 9 illustrates an exemplary embodiment of the female engagement element 34. The female engagement element is a continuous protruding lip 35 which extends along the entire length of the top of the left wall 30 and down each side of left wall 30. In a preferred embodiment, the depth of the protruding lip 35 corresponds to the depth of the panel 33, for example a distance of about 0.15 as described above. Two container modules can be mutually coupled by sliding the panel 33 of one module 12 up into the protruding lip 35 of a second container module 12 and pressing slightly to achieve a snug fit.

Figure 12:
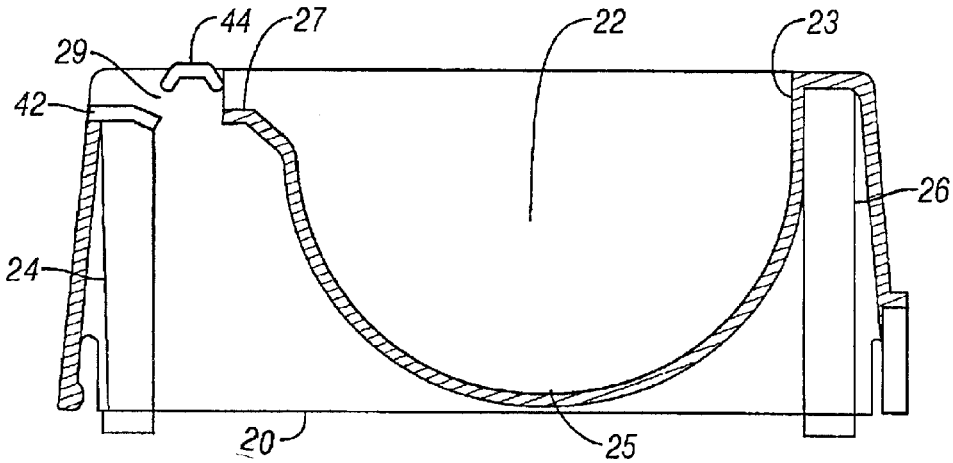
FIG. 12 is a cross-sectional view of FIG. 8 shown along lines 12—12.

The container module 12 includes a receptacle 22 that is configured to accommodate the storage of a roll of adhesive-backed labels. A roll of labels fits within the receptacle 22 and is supported by the right and left walls 28, 30. With reference to FIGS. 1 and 12, each container module has a receptacle 22 that is generally semi-circular in shape. The back portion 23 of receptacle 22 originates at the inside surface of the back wall 26. The back portion 23 is initially parallel to the back wall 26, however it gradually curves into a semi-circular portion 25 that extends up to a top portion 27, that is in alignment with a slit opening 38 in front wall 24. In a preferred embodiment, the semi-circular portion 25 can have a radius of about 4.625. The shape of the receptacle 22 is configured to minimize friction between the roll of labels and the inside surface of the receptacle 22 and the sides 28, 30 as the labels are dispensed. The receptacles 22 of the modules 12 are dimensioned to be approximately the same width as the varies dimensions of standard rolls of labels.

Each container module 12 also includes a slit opening 38 for dispensing the labels from the receptacle 22. The slit opening 38 includes the elements of a flat surface 40, a gap 29 and a horizontal bar 42. See FIGS. 7 and 10. The flat surface 40 extends in a direction perpendicular to the vertical plane of the front wall 24 and includes a slight downward incline 41 toward the interior of the container 12. The flat surface 40 is in parallel alignment with the top portion 27 of receptacle 22. This flat surface 40 provides an area for the labels to rest after exiting through the gap 29 and facilitates access to the labels. The gap 29 is positioned between the flat surface 40 and the horizontal bar 42. The width of gap 29 is several times greater than the thickness of typical lined paper and adhesive-backed labels, thereby providing a relatively frictionless opening for dispensing labels from the container 12. In a preferred embodiment, the gap 29 can be about 0.35 inches in height. While the gap 29 of the slit opening 38 minimizes friction in dispersion of the labels, it does create enough friction against the labels in order to keep the roll from unwinding too rapidly. The horizontal bar 42 is recessed relative to the flat surface 40 and the gap 29 and extends the width of the modular container 12. As the user pulls labels to dispense them through the slit opening 38, the bar 42 exerts a counteracting pressure restraining the forward movement of the roll of labels. The bar 42 also serves to help keep the roll of labels in the receptacle 22.

The adhesive-backed labels are more easily dispensed if the labels are not unrolled through a sharp bend. For this reason, the flat surface 40 is positioned to be in alignment with the top portion 27 of the receptacle 22. Thus, when the lined paper containing the labels is pulled forward to unwind the roll of labels, the lined paper discharges from the contoured semi-circular portion 25 of the receptacle 22 up to the top portion 27 of receptacle 22 and through the gap 29.

Figure 8:
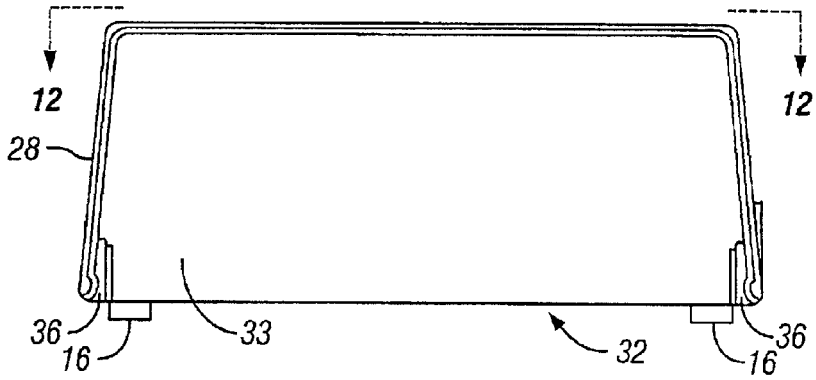
FIG. 8 is a right side view of the individual module of FIG. 7.

Each container module 12 also has one or more notches 36 on the lower outside edges of the right and left walls 28, 30. Notches 36 provide flexibility to a container module 12 by accommodating, for example, changes in dimension due to a change in temperature or load pressure. FIGS. 8 and 9 show one embodiment wherein there is a notch 36 in the lower right and left corners of both the right wall 28 and left wall 30 of each container module 12.

Figure 6:
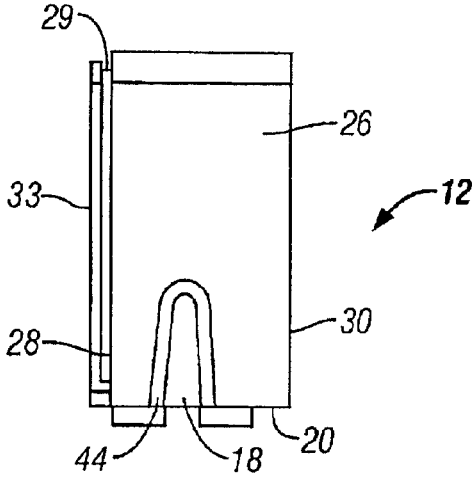
FIG. 6 is a back view of an individual module of the container of FIG. 1.
Figure 7:
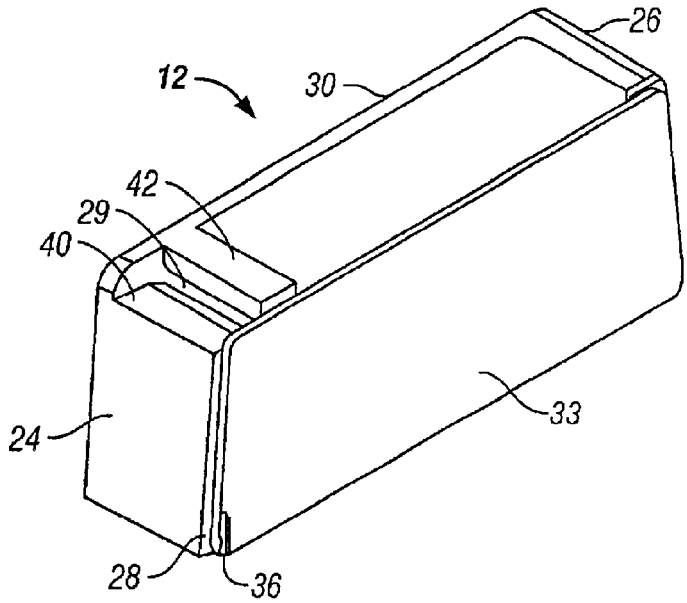
FIG. 7 is a perspective view of an individual module of the container system of FIG. 1.

With reference to FIGS. 3 and 6, a generally arch-shaped aperture 18 is centrally positioned on the bottom edge of the back wall 26 which provides a point of attachment for securing the modular container 12 to a parallel flat surface. A reinforcing lip 44 outlines the aperture 18 and gives greater stability for hanging a modular container 12 onto a peg, hook or other device in order to attach the container 12 and/or the modular container system 10 to a vertical surface.

In one embodiment of the invention, the outer side of bottom surface 20 includes two opposing pairs of feet 16 in which a pair of feet 16 is positioned on each end of the module 12. Feet 16 may be molded as part of the bottom surface 20 or they may be made separately and attached to the bottom surface 20 in some manner known to one skilled in the art. Feet 16 allow the container modules 12 to be elevated from a counter top and assist in allowing the container 12 to rest evenly on a surface.

In a preferred embodiment of the invention, generally trapezoidal shaped end pieces 14 are attached to each end of a modular container system 10 in order to provide a finished look to the container system 10. As discussed above, the connecting mechanism of each module 12 comprises a male engagement element 32 on the right wall 28 and female engagement element 34 on the left wall 30. Accordingly, in a coupled modular container system 10, one end will have a module 12 with an exposed outer right wall 28 having a male engagement element 32 and the other end will have a module 12 with an exposed outer left wall 30 having a female engagement element 34. A pair of end pieces 14 will include a right end piece 14*a* having a female engagement element 34 and a left end piece 14*b* with a male engagement element 32. Each end piece 14 includes a bottom surface 20*a* having a foot 16 positioned on the front end and on the back end of the bottom surface 20*a*. The addition of the end pieces 14 offers several advantages such as stability to the modular unit and enhancement of the general appearance of the modular container system 10.

Thus the modular container system 10 of the present invention provides for a label dispensing system that has a number of connected containers for storing and dispensing multiple rolls of different labels that allows for visualization of the rolls of labels. It also provides for a label container system that includes a series of modular containers of varying width that can be connected in any selected arrangement of widths for accommodating a variety of different labels.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A modular container system for storing and dispensing labels, a container system comprising:

a plurality of individual container modules configured for mutual coupling, wherein each module has a bottom surface and a plurality of walls extending upwardly from the periphery of said bottom surface, and the plurality of upwardly extending walls includes a front wall, a back wall, a right wall and a left wall;

each container module having a first engagement element on a first wall and a complementary second engagement element on a second opposing wall, wherein the first engagement element is a panel that is parallel to and contiguous with the first wall and the second engagement element is a protruding lip that extends across the entire length of the second opposing wall's top and down each of the second walls' sides; and each container module having an open receptacle including a curved generally semi-circular portion, the receptacle being configured for receiving a roll of labels and an opening for dispensing the labels.

2. The container system of claim 1, wherein the first wall is a right wall and the second wall is a left wall.

3. The container system of claim 1, wherein an outer surface of the bottom surface of each module includes two pairs of opposing feet allowing each module to be elevated from a surface and assisting in even placement of the system upon the surface.

4. The container system of claim 1, wherein the plurality of individual container modules include generally trapezoidal shaped right and left end pieces, the right end piece including a second engagement element and the left end piece including a first engagement element.

5. The container system of claim 1, wherein the receptacle further includes a back portion in generally parallel alignment with a back wall, the back portion curving down into the generally semi-circular portion that extends up to a top portion.

6. The container system of claim 1, further including a slit opening positioned in the front wall, the slit opening including a flat surface, a horizontal bar and a gap positioned between the flat surface and the horizontal bar, the flat surface is parallel to and aligned with a top portion of the receptacle.

7. The container system of claim 1, wherein an aperture is centrally positioned on a bottom edge of at least two back walls of the container system, the apertures providing a point of attachment for the container system to a parallel flat surface.

8. The container system of claim 1, wherein each container module is provided in a variety of widths in order to conform to rolls of labels having different widths.

9. A container module for storing and dispensing labels, the module comprising:

a) a generally rectangular shaped container having a bottom surface and a plurality of upwardly extending walls including a front wall, a back wall, a right wall and a left wall;

b) a first engagement element on a first wall and a complementary second engagement element on a second opposing wall, wherein the first engagement element is a panel that is parallel to and contiguous with the first wall and the second engagement element is a protruding lip that extends the entire length of the top and down each side of the second opposing wall; and c) an open receptacle including a curved generally semi-circular portion, the receptacle being configured for receiving a roll of labels and dispensing the labels.

10. The container module of claim 9, wherein the first wall is a right wall and the second wall is a left wall.

11. The container module of claim 9, wherein an outer surface of the bottom surface of each module includes two pairs of opposing feet allowing the module to be elevated from a surface and assisting in even placement of the module upon the surface.

12. The container system of claim 9, wherein the receptacle further includes a back portion in generally parallel alignment with a back wall, the back portion curving down into the generally semi-circular portion that extends up to a top portion.

13. The container module of claim 9, further including a slit opening positioned in the front wall, the slit opening including a flat surface, a horizontal bar, the flat surface is parallel to and aligned with a top portion of the receptacle.

14. The container module 9, wherein an aperture is centrally positioned on a bottom edge of the back wall, the aperture providing a point of attachment for the module to a parallel flat surface.

* * * * *